US007600502B2

(12) United States Patent
Welzmueller et al.

(10) Patent No.: US 7,600,502 B2
(45) Date of Patent: Oct. 13, 2009

(54) DAMPING DEVICE AND DAMPING ELEMENT

(75) Inventors: Roland Welzmueller, Unterschleissheim (DE); Stefan Weiss, Geigant (DE); Ekkehard Gorski, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 12/199,608

(22) Filed: Aug. 27, 2008

(65) Prior Publication Data

US 2008/0314366 A1 Dec. 25, 2008

Related U.S. Application Data

(63) Continuation of application No. PCT/EP2007/000180, filed on Jan. 11, 2007.

(30) Foreign Application Priority Data

Feb. 28, 2006 (DE) ..... 10 2006 009 094

(51) Int. Cl.
*F02M 61/14* (2006.01)

(52) U.S. Cl. ..... 123/470

(58) Field of Classification Search ..... 123/468, 123/469, 470

See application file for complete search history.

(56) References Cited

U.S. PATENT DOCUMENTS

| | | | | |
|---|---|---|---|---|
| 2,987,284 | A * | 6/1961 | Ushkaritys | 248/74.3 |
| 3,302,915 | A * | 2/1967 | Usher | 248/74.3 |
| 4,492,201 | A * | 1/1985 | Radaelli | 123/470 |
| 4,747,624 | A | 5/1988 | Faber et al. | |
| 5,044,340 | A * | 9/1991 | Robnett | 123/470 |
| 5,129,658 | A * | 7/1992 | Berton et al. | 277/591 |
| 5,482,330 | A | 1/1996 | Holzhausen | |
| 5,682,859 | A * | 11/1997 | Wakeman | 123/470 |
| 5,785,024 | A | 7/1998 | Takei et al. | |
| 6,334,433 | B1 | 1/2002 | Sumida et al. | |
| 6,460,512 | B1 * | 10/2002 | Serio | 123/470 |
| 7,261,089 | B2 * | 8/2007 | Hoenig et al. | 123/470 |
| 7,293,550 | B2 * | 11/2007 | Beardmore | 123/470 |
| 7,377,264 | B2 * | 5/2008 | Buehner | 123/470 |
| 2002/0020288 | A1 * | 2/2002 | Dougami | 92/85 R |
| 2004/0040543 | A1 | 3/2004 | Mickelson | |
| 2007/0033940 | A1 * | 2/2007 | Duverneuil et al. | 60/743 |
| 2007/0111833 | A1 * | 5/2007 | Young | 474/152 |

(Continued)

FOREIGN PATENT DOCUMENTS

DE 100 55 435 A1 5/2001

(Continued)

OTHER PUBLICATIONS

German Search Report dated Aug. 7, 2006 with an English translation (Nine (9) pages).

(Continued)

*Primary Examiner*—Thomas N Moulis
(74) *Attorney, Agent, or Firm*—Crowell & Moring LLP

(57) ABSTRACT

A damping system arranged in the region of an injector base between a cylinder head and an injector mounted thereon of an internal combustion engine has a multi-part construction. A damping element forming part of the damping system is constructed as a metal cushion.

20 Claims, 3 Drawing Sheets

U.S. PATENT DOCUMENTS

| | | | | |
|---|---|---|---|---|
| 2007/0163545 | A1* | 7/2007 | Beardmore et al. | 123/456 |
| 2007/0175451 | A1* | 8/2007 | Beardmore | 123/470 |

FOREIGN PATENT DOCUMENTS

| | | | |
|---|---|---|---|
| DE | 199 47 071 | A1 | 5/2001 |
| DE | 100 38 763 | A1 | 2/2002 |
| DE | 100 57 495 | A1 | 5/2002 |
| DE | 101 26 336 | A1 | 12/2002 |
| DE | 101 32 756 | A1 | 1/2003 |
| DE | 103 48 291 | A1 | 5/2005 |
| DE | 10 2004 060 462 | A1 | 3/2006 |
| DE | 10 2004 053 040 | A1 | 5/2006 |
| EP | 0 825 342 | A1 | 2/1998 |
| EP | 1 223 337 | A1 | 7/2002 |
| JP | 6-10794 | A | 1/1994 |

OTHER PUBLICATIONS

International Search Report dated May 16, 2007 with an English translation of the pertinent portions Six (6) pages).

* cited by examiner

Fig. 1a
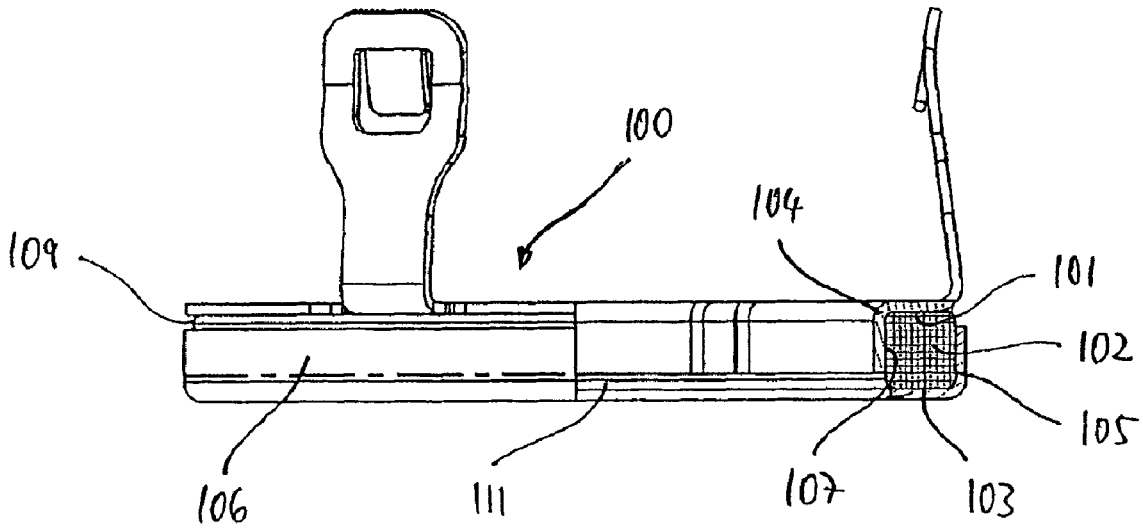
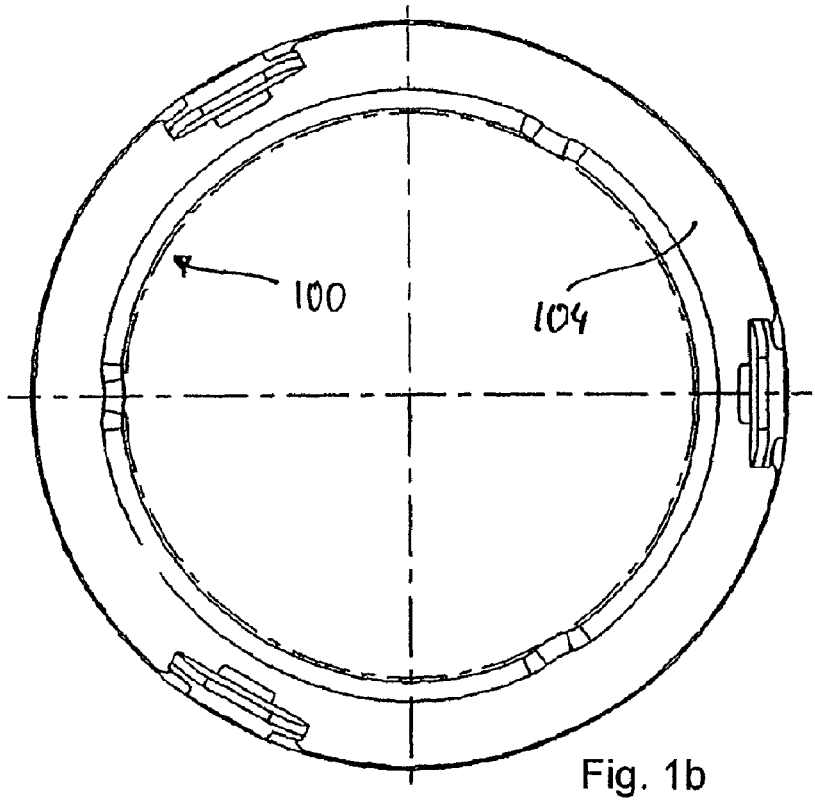
Fig. 1b

DAMPING DEVICE AND DAMPING ELEMENT

CROSS-REFERENCE TO RELATED APPLICATIONS

This application is a continuation of PCT Application No. PCT/EP2007/000180, filed on Jan. 11, 2007, which claims priority to German Patent Application No. 10 2006 009 094.2, filed on Feb. 28, 2006, the disclosures of which are incorporated by reference herein.

BACKGROUND AND SUMMARY OF THE INVENTION

The invention relates to a damping system for an arrangement between a cylinder head and an injector mounted thereon, particularly in the region of the injector base, as well as to a damping element for an arrangement between the cylinder head and the injector mounted thereon, particularly in the region of the injector base.

In the case of internal-combustion engines having a crankcase, a cylinder head and a combustion chamber, fuel is normally injected into the combustion chamber by means of an injector. For this purpose, the cylinder head of the internal-combustion engine has a dome, which leads into the combustion chamber and in which the injector is accommodated. During the intermittent injection in the operation of the internal-combustion engine, strong vibrations, which have a negative effect on comfort and acoustics, are generated as a result of the opening and closing of the injector valve. Particularly at increased fuel pressures, as may prevail in direct-injection systems of Otto and diesel engines, the vibration-caused stress is intensified. Furthermore, modern combustion methods, in which multiple injection takes place during the intake and compression stroke, especially contribute to the undesirable development of noise and vibrations.

For reducing the noise emission, it had been suggested to brace the injector mounted on the cylinder head and to arrange a damping element at the connection point between the cylinder head and the injector. This type of an arrangement having a damping element is known from German Patent document DE 101 26 336 A1, where it is suggested to use graphite, a plastic material, or a memory metal as the material for the damping element. In this case, the known damping element is constructed in one piece.

In order to achieve a high damping effect, it is necessary in this case that a sufficient quantity of damping material be arranged between the injector and the cylinder head and that the damping element be designed to be correspondingly voluminous. In this case, it was found to be disadvantageous that an exact positioning of the injector with respect to the cylinder head and thus of the injection point in the combustion chamber cannot always be achieved. In particular, because of high dimensional tolerances and an elastic or plastic deformation of the damping element, the injector and, therefore, the injection point may be displaced over time, so that the operation of the internal-combustion engine is impaired.

It is therefore an object of the invention to improve up the above-mentioned damping system or damping element such that, in addition to an effective damping and an uncoupling of the injector from the cylinder head, low dimensional tolerances and a precisely positioned fixing of the injector with respect to the cylinder head are also achieved. In addition, an elastic and/or a plastic deformation of the damping element over its service life should be avoided.

This object is achieved by providing a damping system having a multipart construction. The multipart construction permits the integration of further functions, in addition to the damping, in the damping system. Another solution of the same task is obtained by providing a damping element made of a metal cushion.

Particularly advantageous developments and further developments of the invention are described and claimed herein.

It is preferable for the damping system to have a first partial function area, which is essentially suitable for the damping, and a second partial function area, which is essentially suitable for the precisely positioned fixing.

The first partial function area expediently includes an element that dampens based on the characteristic of its material and/or its design. In this case, it was found to be advantageous to use a metal cushion made of a wire mesh which, as required, contains coated wires and/or synthetic fibers. In addition to the material used, the special damping characteristic is also the result of the special design and/or the construction of the first partial function area. A very high energy dissipation takes place in the metal cushion made of wire mesh as a result of the friction between the wires. The degree of damping can still be increased by coating the wire and/or interwoven synthetic fibers. In connection with the good damping characteristic, the mechanical dimensional stability of the metal cushion is particularly advantageous.

It is very advantageous for the first partial function area to be further developed in a ring-shaped fashion, having at least approximately a rectangular or square cross-section.

The second partial function area preferably includes a first injector-side part as well as a second cylinder-head-side part, the first and the second part of the second partial function area being mutually connected by way of the first partial function area. In this context, the uncoupling from the first and the second part of the second partial function area is essential.

Expediently, the first part of the second partial function area is further developed as an inner ring reaching around the first partial function area on the interior side and the injector side, and the second part of the second partial function area is further developed as an outer ring surrounding the first partial function area on the outer side and the cylinder head side. Because of its bowl-type further development, the second part of the second partial function area is suitable for collecting, for example, abraded particles from the metal cushion made of a wire mesh or other particles, so that such particles are advantageously prevented from entering into the combustion chamber. In that the second part of the second partial function area is arranged between the cylinder head and the first partial function area, wear at the cylinder head as a result of abrasion is avoided and the damping effect is simultaneously increased.

It is advantageous for the first and the second part of the second partial area to be connected with the first partial function area by way of a clamp fit.

In the case of the damping element according to the invention, the metal cushion preferably consists of a wire mesh or of a metal foam. A further improvement of the damping characteristic can be achieved in that the metal cushion includes coated wires, synthetic fibers, and/or graphite.

The metal cushion expediently has a ring-shaped design, having an at least approximately rectangular or square cross-section so that, particularly in connection with the selected material of the damping element, a particularly high positioning and measuring accuracy is achieved.

Other objects, advantages and novel features of the present invention will become apparent from the following detailed description of the invention when considered in conjunction with the accompanying drawings.

BRIEF DESCRIPTION OF THE DRAWINGS

FIG. 1*a* is a schematic lateral sectional view of an embodiment of a damping system;

FIG. 1*b* is a schematic top view of an embodiment of a damping system;

DETAILED DESCRIPTION OF THE DRAWINGS

Figure 2:
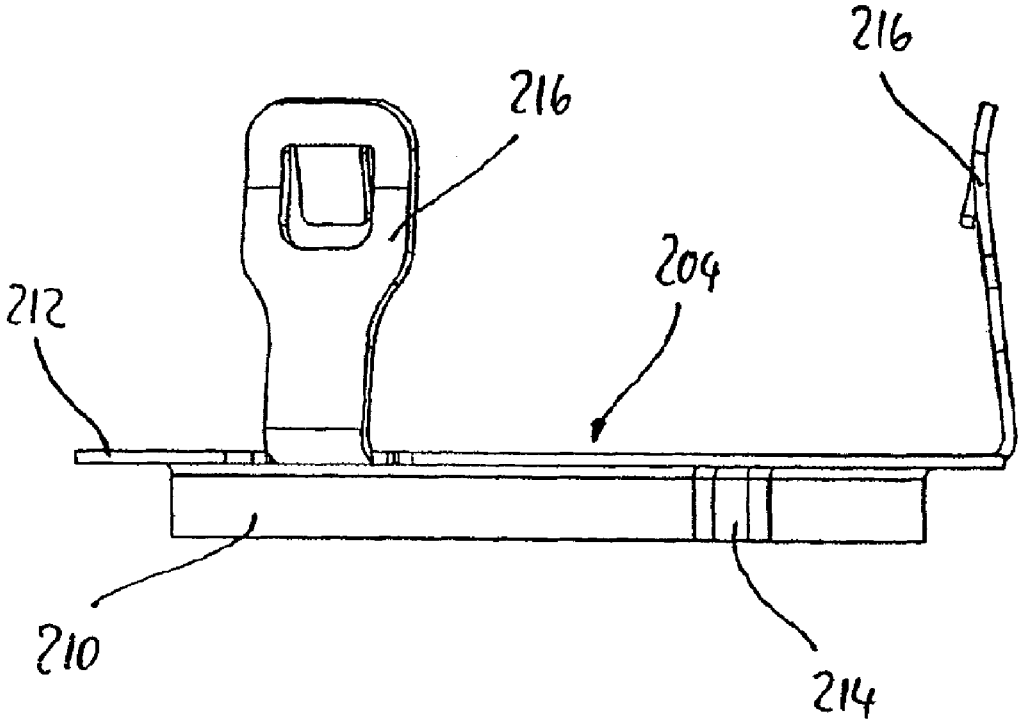
FIG. 2 is a schematic view of an embodiment of an inner ring of a damping system.

FIG. 1*a* is a partially sectional lateral view of a damping system 100; FIG. 1*b* is a corresponding top view. The damping system 100 includes a ring-shaped damping element 102 with a square or rectangular cross-section, so that two parallel contact surfaces 101, 103 as well as a ring-shaped outer surface 105 and a ring-shaped inner surface 107 are formed. The damping element 102, which forms a first partial function area, is presently formed as a metal cushion made of a pressed wire mesh and consists of stainless steel. However, generally other materials which have a high dissipation factor may also be used; that is, which have the characteristic of converting a high fraction of mechanical energy into heat by internal friction. For example, elastomer plastics, special ferromanganese alloys, metallic alloys with a shape memory effect or materials including graphite can also be used.

The damping element 102 is surrounded by an inner ring 104 and an outer ring 106, which jointly form a second partial function area for the accurately positioned fixing. The inner ring 104 as well as the outer ring 106 are form-lockingly connected with the damping element 102, for example, by way of a clamping connection, but are uncoupled from one another in that respective gaps 109, 111 are formed that remain free. In order to prevent, for example, abraded particles of the damping element 102 from reaching the outside, the damping element 102 may be completely encapsulated by sealing the gaps 109, 111. In this case, the gap sealing preferably is similarly compressible as the damping element 102. Such a gap sealing device may be constructed as bellows made of metal or plastic material.

The inner ring 104, 204 is illustrated in FIG. 2. It is ring-shaped, and is further developed with an angular cross-section, so that a disk-shaped area 212 is formed for the injector-side contact on the contact surface (FIG. 1*a*: 101) of the damping element, and a ring-shaped area 210 is formed for a contact on the interior surface (FIG. 1*a*: 107) of the damping element. Flexible tongues 216 are provided, which start from the disk-shaped area 212 of the inner ring 204. By use of the flexible tongues 216, the damping element can be connected with an injector, so that a mounting is facilitated, and it is avoided that the installation of the damping element is forgotten. In addition, inward-oriented elastic projections 214 are provided for the force- and form-locking connection of the damping element 100 with the injector.

Figure 3:
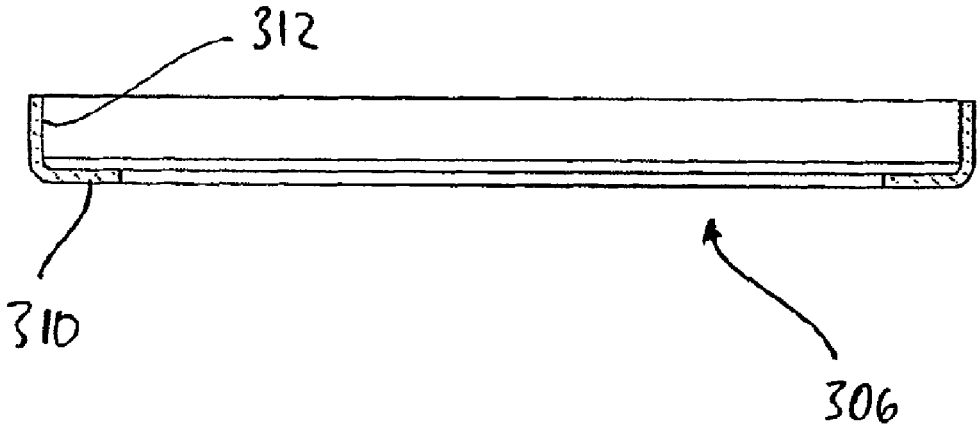
FIG. 3 is a schematic view of an embodiment of an outer ring of a damping system.

The outer ring (FIG. 1: 106) of the damping system is illustrated in FIG. 3 and there has the reference number 306. The outer ring 306 also has a ring-shaped further development with an angular cross-section, a disk-shaped surface 310 being formed for the cylinder-head-side contact on the contact surface (FIG. 1*a*: 103) of the damping element, and a ring-shaped area 312 being formed for the contact on the outer-side surface (FIG. 1*a*: 105) of the damping element. In the case of a further development of the invention with a damping element 102 made of a highly elastomeric material, the ring-shaped area 312 of the outer ring 306 limits the transverse expansion of the damping element 102 in the outer direction, so that the stiffness of the sealing arrangement is increased in the axial direction and the positioning precision of the injection point in the combustion chamber is increased.

In the present case, the inner ring 204 as well as the outer ring 306 consist of high-grade steel and are stamped from sheet metal and bent. The combination of the inner ring 204 and the damping element 102 and the outer ring 306 is force- and form-lockingly joined by utilizing the spring effect of the wire mesh (102). As an alternative, a connection can also take place by way of spot welding or an adhesive substance.

Figure 4:
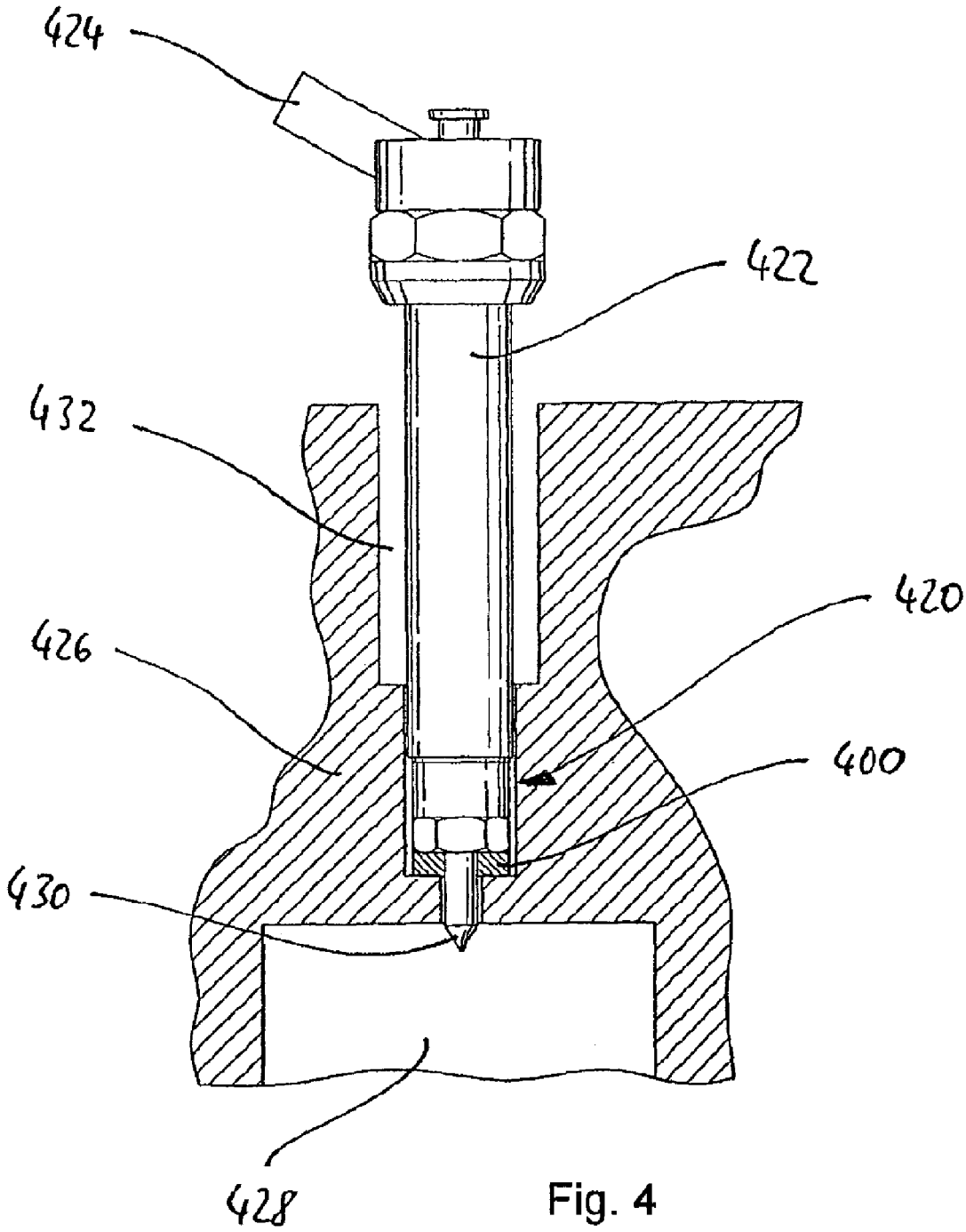
FIG. 4 is a schematic view of an embodiment of a cylinder head with a fuel injector mounted thereon and a damping system.

FIG. 4 illustrates a cutout from an internal-combustion engine (not shown here in detail) having a crankcase, a cylinder head 426, and a combustion chamber 428, which chamber 428 is enclosed by the cylinder head 426. The cylinder head 426 of the internal-combustion engine has a dome 432 leading into the combustion chamber 428, in which dome 432 an injector 422 is accommodated. The injector 422 includes a connection 424 to the fuel supply as well as a nozzle 430 projecting into the combustion chamber 428. A damping system 400 according to the invention is arranged at the contact point between the cylinder head 426 and the injector 422 in the area of the injector base 420.

By way of the illustrated arrangement, the vibrations generated during the intermittent fuel injection while the internal-combustion engine is operating are effectively damped—also in the case of fuel pressures predominant in direct-injection systems in Otto and diesel engines. Simultaneously, a highly accurate injector position and thus a lastingly precise injection point in the combustion chamber 428 are achieved. The damping system according to the invention makes it possible to observe very low dimensional tolerances, which so far could take place only with extremely thin uncoupling elements, which have a correspondingly low damping effect. By use of the damping system, a vibration damping is achieved as well as a vibration uncoupling.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A multipart-constructed damping system for use in an area of an injector base between a cylinder head and an injector mounted on the cylinder head, comprising:

a first partial function area essentially suitable for damping;

a second partial function area essentially suitable for precisely positioned fixing, the first partial function area comprising a damping element formed as a ring-shaped metal cushion made of a wire mesh and having an at least approximately rectangular cross-section, and the second partial function area comprising a first injector-side part and a second cylinder-head side part, wherein the first and second parts are mutually connected by way of the first partial function area;

wherein the first part of the second partial function area comprises an inner ring with an angled cross-section, a disk-shaped area of the inner ring reaching around the first partial function area on an inside and injector side, and wherein the second part of the second partial function area comprises an outer ring with an angled cross-section, a disk-shaped area of the outer ring reaching around the first partial function area on an outside and cylinder head side.

2. The damping system according to claim 1, wherein the first part of the second partial function area extends on the inside along a predominant height area of the first partial function area.

3. The damping system according to claim 1, wherein the second part of the second partial function area extends on the outside along a predominant height area of the first partial function area.

4. The damping system according to claim 2, wherein the second part of the second partial function area extends on the outside along a predominant height area of the first partial function area.

5. The damping system according to claim 1, further comprising one gap respectively formed between the first part and the second part of the second partial function area on the injector side outside and on the cylinder head side inside, whereby the first part and the second part of the second partial function area are uncoupled from one another.

6. The damping system according to claim 4, further comprising one gap respectively formed between the first part and the second part of the second partial function area on the injector side outside and on the cylinder head side inside, whereby the first part and the second part of the second partial function area are uncoupled from one another.

7. The damping system according to claim 1, wherein the first part of the second partial function area is operatively configured for a force- or form-locking connection with the injector.

8. The damping system according to claim 7, wherein the first part of the second partial function area has elastic tongues.

9. The damping system according to claim 7, wherein the first part of the second partial function area has inward oriented elastic projections.

10. The damping system according to claim 8, wherein the first part of the second partial function area has inward oriented elastic projections.

11. The damping system according to claim 1, wherein the damping element comprises at least one of coated wires and synthetic fibers.

12. The damping system according to claim 1, wherein the first and the second part of the second partial function area are connected with the first partial function area via a clamp fit.

13. The damping system according to claim 4, wherein the first and the second part of the second partial function area are connected with the first partial function area via a clamp fit.

14. The damping system according to claim 5, wherein the first and the second part of the second partial function area are connected with the first partial function area via a clamp fit.

15. A damping element for use in a multi-part constructed damping system operatively arranged between a cylinder head and an injector of an internal combustion engine at a base of the injector, the damping element comprising a metal cushion.

16. The damping element according to claim 15, wherein the metal cushion is made of a wire mesh.

17. The damping element according to claim 15, wherein the metal cushion is made of a metal foam.

18. The damping element according to claim 15, wherein the metal cushion comprises at least one of coated wires, synthetic fibers, and graphite.

19. The damping element according to claim 15, wherein the metal cushion is ring-shaped, having an at least approximately rectangular cross-section.

20. The damping element according to claim 18, wherein the metal cushion is ring-shaped, having an at least approximately rectangular cross-section.

* * * * *